US009629468B1

(12) United States Patent
McCabe et al.

(10) Patent No.: US 9,629,468 B1
(45) Date of Patent: Apr. 25, 2017

(54) TRAVEL PILLOW ASSEMBLY

(71) Applicants: Edward Casey McCabe, Delta (CA); Oi (Katie) Huang, Delta (CA)

(72) Inventors: Edward Casey McCabe, Delta (CA); Oi (Katie) Huang, Delta (CA)

( * ) Notice: Subject to any disclaimer, the term of this patent is extended or adjusted under 35 U.S.C. 154(b) by 0 days.

(21) Appl. No.: 15/135,014

(22) Filed: Apr. 21, 2016

(51) Int. Cl.
*A47C 7/38* (2006.01)
*A47G 9/10* (2006.01)
*A44B 11/25* (2006.01)

(52) U.S. Cl.
CPC ..... *A47C 7/383* (2013.01); *A44B 11/2557* (2013.01); *A47G 9/1054* (2013.01); *A47G 9/1081* (2013.01); *A47G 2009/1018* (2013.01)

(58) Field of Classification Search
CPC .. A47C 7/36; A47C 7/38; A47C 7/383; A47C 1/036; A44B 11/00; A44B 11/2553; A44B 11/2557; A47G 9/10; A47G 9/1054; A47G 9/1081; A47G 2009/1018
See application file for complete search history.

(56) References Cited

U.S. PATENT DOCUMENTS 382,949 A * 5/1888 Campbell ..... A47C 7/383 297/393
4,097,086 A * 6/1978 Hudson ..... B60N 2/4879 297/217.1
4,565,408 A * 1/1986 Palley ..... A47C 7/383 297/392
4,627,587 A 12/1986 McCutchan et al.
5,177,837 A * 1/1993 Rekuc ..... A44B 11/00 24/198
5,345,633 A * 9/1994 Harnish ..... B60N 2/4879 224/579
5,645,319 A 7/1997 Parks, Jr.
5,806,087 A * 9/1998 Grotefend ..... A41F 9/005 2/1

(Continued)

FOREIGN PATENT DOCUMENTS

DE 102009007384 A1 8/2009
DE 102015003539 B3 1/2016

OTHER PUBLICATIONS

Author unknown; http://global.rakuten.com/en/store/suitcase-shop/item/72044435/11; website; unknown date of publication; no page or volume number, published on the internet.

*Primary Examiner* — David E Sosnowski
*Assistant Examiner* — David R Hare

(57) ABSTRACT

A travel pillow assembly can include a belt assembly, a neck pillow, and first and second suspension member assemblies. The belt assembly can include a first elongate member and a first buckle member. The belt assembly is operable to fixedly and releasibly surround a plurality of perimeters of different size. The neck pillow can extend a pillow length from a first end, through a midpoint position, and to a second end. The first and second suspension member assemblies can each be operatively connected to the first elongate member and extend a respective suspension member length. Each can releasibly form a pillow engagement loop to encircle the neck pillow and can have a second buckle member to maintain the suspension member in a plurality of orientations, a distance between the second buckle member and the pillow engagement loop being adjustable.

18 Claims, 5 Drawing Sheets

(56) References Cited

U.S. PATENT DOCUMENTS

| | | | | |
|---|---|---|---|---|
| 5,964,504 | A * | 10/1999 | Hogan | B60N 2/4879 297/220 |
| 6,042,185 | A | 3/2000 | Cowgur | |
| 6,266,832 | B1 * | 7/2001 | Ezell | A47G 9/10 297/219.12 |
| 6,641,221 | B1 * | 11/2003 | Kastlunger | A47C 7/383 297/392 |
| 6,647,573 | B2 | 11/2003 | Corbin | |
| 6,793,287 | B2 * | 9/2004 | Dunk | B60N 2/2881 297/219.12 |
| 6,805,403 | B2 | 10/2004 | Buch | |
| 7,722,122 | B2 * | 5/2010 | Mittelstadt | B60N 2/4882 297/397 |
| 7,758,125 | B2 * | 7/2010 | Mittelstadt | A47C 7/383 297/397 |
| 8,985,693 | B2 | 3/2015 | Purpura et al. | |
| 2001/0054837 | A1 * | 12/2001 | O'Connor | A47C 7/383 297/397 |
| 2004/0026979 | A1 | 2/2004 | Haddon | |
| 2010/0117435 | A1 | 5/2010 | Samuelsen | |
| 2012/0030876 | A1 * | 2/2012 | Schwingendorf | A47G 9/1054 5/640 |
| 2012/0222219 | A1 | 9/2012 | Pusca | |
| 2013/0106163 | A1 | 5/2013 | Purpura et al. | |
| 2015/0020314 | A1 * | 1/2015 | Garcia | B60N 2/4879 5/636 |
| 2015/0061340 | A1 * | 3/2015 | Fleming | B60N 2/4879 297/391 |
| 2015/0107025 | A1 * | 4/2015 | Dauphin | A47C 7/383 5/638 |
| 2015/0274044 | A1 * | 10/2015 | Kreppein | A47G 9/1081 5/636 |

* cited by examiner

TRAVEL PILLOW ASSEMBLY

BACKGROUND

1. Field

The present disclosure relates to a device intended to receive a human head for the purpose of repose and more particularly to head or neck supporting means which contains a passage or hole through which a user can breathe.

2. Description of Related Prior Art

U.S. Pat. Pub. No. 2015/0107025 discloses a TRAVEL PILLOW CUSHION WITH STRAP AND POUCH AND SEAT BRACKET WITH SUPPORT TRAY FOR TRAIN SEATS, BUS SEATS AND COMMERCIAL AIRLINE SEATS. A travel pillow cushion is designed with means and devices for anchoring pillow cushion to the head rest of train seats or bus seats using the special adjustable strap with pouch. And for future seat designs, one will be able to mount the pillow cushion in front of himself/herself using the special bracket with female catch slots and the pillow cushion support tray with male hook hanger end. So, a person can rest during travel in a forward leaning inclined position on a bus seat or train seat.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A travel pillow assembly can include a belt assembly, a neck pillow, and first and second suspension member assemblies. The belt assembly can include a first elongate member of flexible material extending a belt length between a first end and a second end and be configured to elastically deform to surround a perimeter of another structure. The belt assembly can also include a first buckle member receiving the first elongate member and can be configured to maintain the first elongate member in a plurality of different orientations where the belt assembly is operable to fixedly and releasibly surround a plurality of perimeters of different size. The neck pillow can extend a pillow length along a truncated, omega-shaped path about a nonlinear axis from a first end, through a midpoint position, and to a second end. The first and second suspension member assemblies can each be operatively connected to the first elongate member along the belt length, can each extend a respective suspension member length, can each be configured to releasibly form a respective pillow engagement loop operable to selectively encircle the neck pillow along the nonlinear axis between the midpoint position and one of the first and second ends of the neck pillow, and can each have a respective second buckle member positioned along the respective suspension member length and spaced from the pillow engagement loop along the respective suspension member length. The second buckle member can be configured to maintain the respective suspension member in a plurality of different orientations where a distance between the second buckle member and the pillow engagement loop is adjustable along the respective suspension member length.

BRIEF DESCRIPTION OF THE DRAWINGS

The detailed description set forth below references the following drawings.

DETAILED DESCRIPTION

Figure 1:
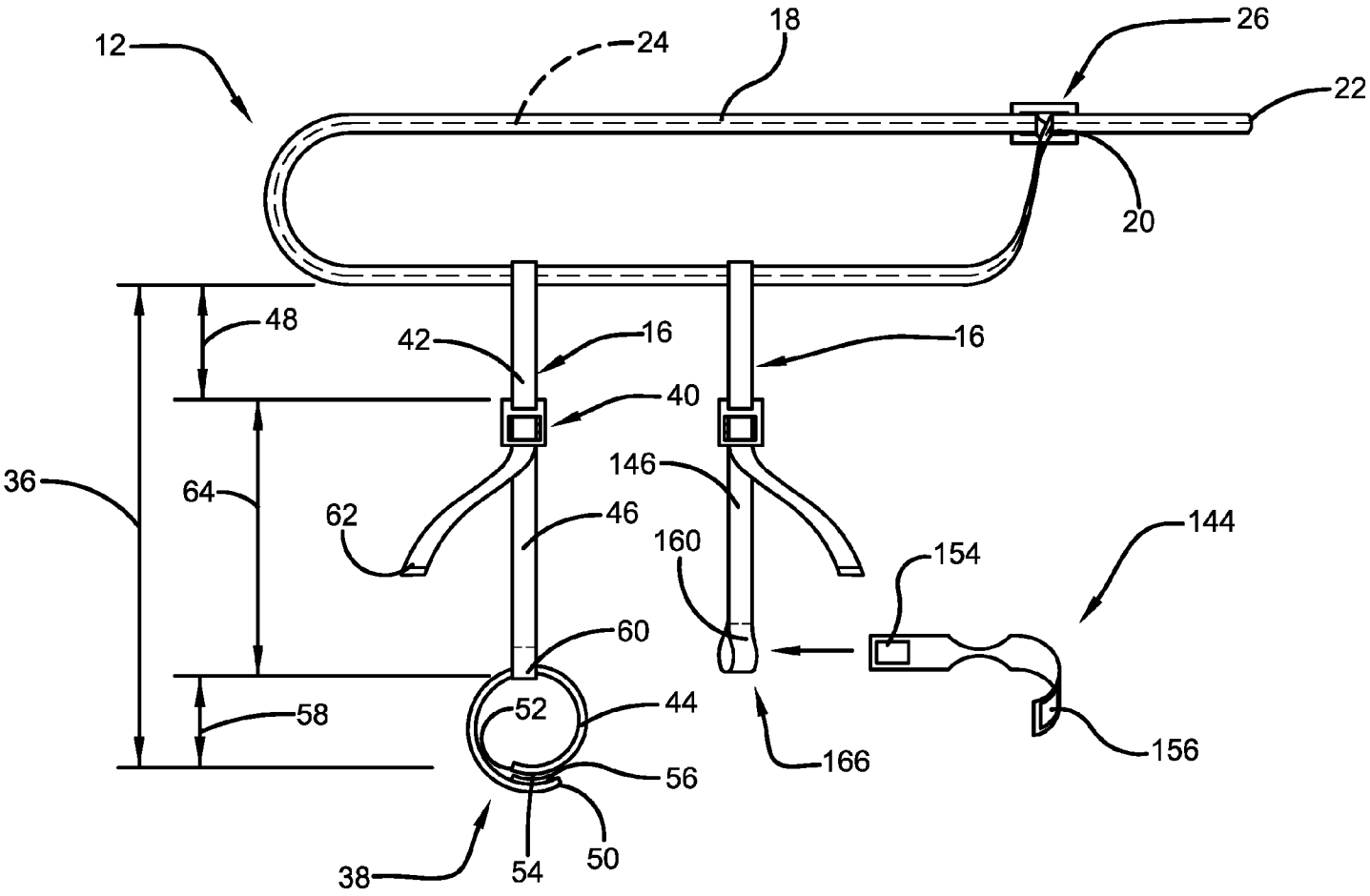
FIG. 1 is a generally planar view of a portion of an exemplary embodiment of the present disclosure laid substantially flat on a surface.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

Figure 2:
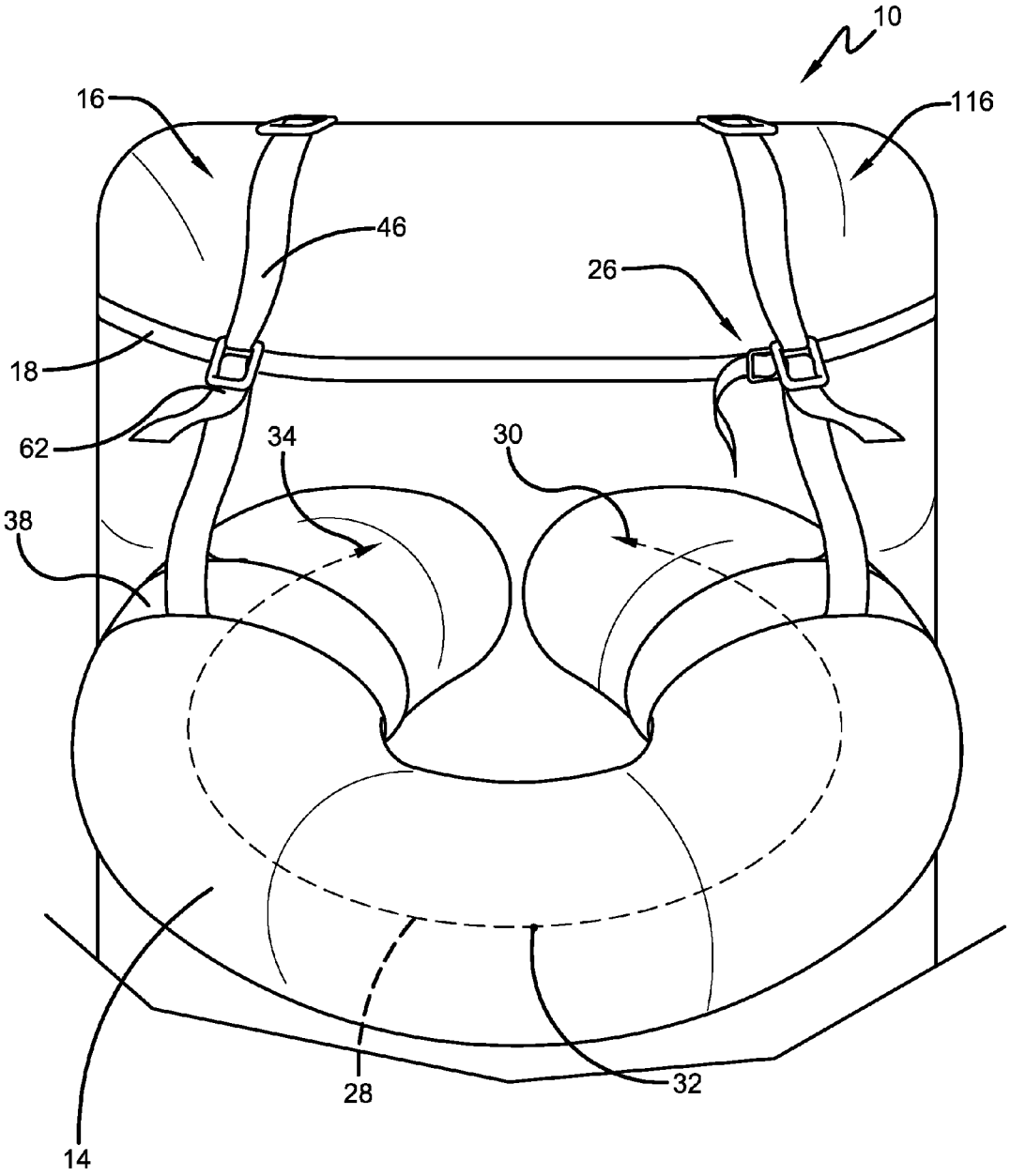
FIG. 2 is a perspective view of the embodiment partially shown in FIG. 1 in an operating configuration.
Figure 3:
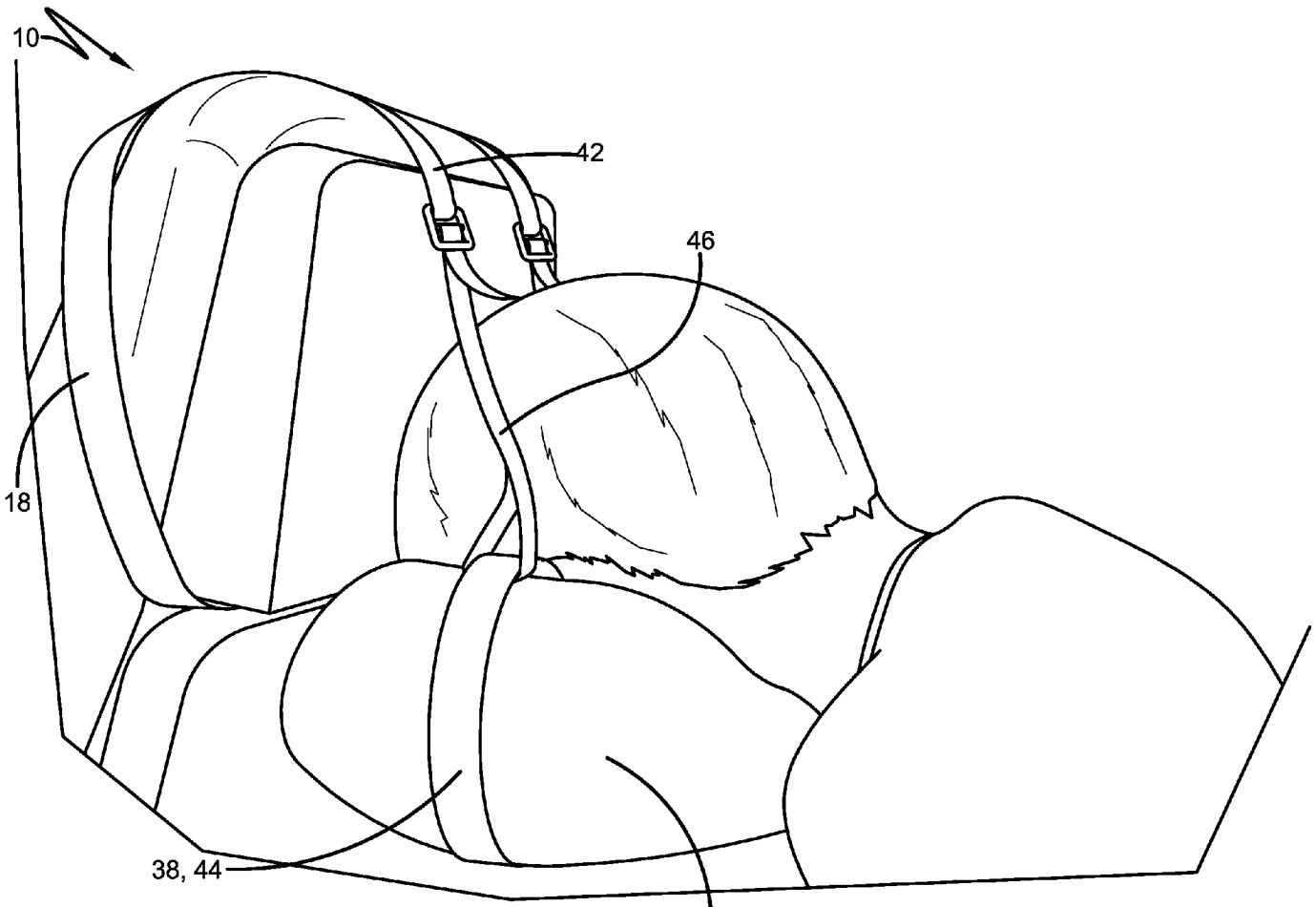
FIG. 3 is a perspective view of the embodiment shown in FIG. 2 being used while in the operating configuration.

Referring now to FIGS. 1-3, a travel pillow assembly 10 can include a belt assembly 12, a neck pillow 14, and first and second suspension member assemblies 16, 116. The belt assembly 12 can include a first elongate member 18 of flexible material extending a belt length between a first end 20 and a second end 22. The belt length is defined by the axis 24 in dash line. The first elongate member 18 can be configured to elastically deform to surround a perimeter of another structure, such as portion of seat on an airplane, train, or bus.

With continuing reference to FIGS. 1-2, the belt assembly 12 can include a first buckle member 26 receiving the first elongate member 18. The first end 20 can be fixedly attached to the first buckle member 26. The second end 22 can be wound through the first buckle member 26. The first buckle member 26 can be configured to maintain the first elongate member 18 in a plurality of different orientations whereby the belt assembly 12 is operable to fixedly and releasibly surround a plurality of perimeters of different size. Fixedly and releasibly refers to the capacity of the first buckle member 26 to fix the first elongate member 18 in a particular orientation as long as the user desires and then release the first elongate member 18 to be adjusted, such as being fixed around a seat for use and then loosened to be removed from the seat. Fixedly without releasibly refers to a connection that can be permanent, such as the exemplary connection between the first end 20 and the first buckle member 26.

With continuing reference to FIG. 2, the neck pillow 14 can extend a pillow length along a truncated, omega-shaped path about a nonlinear axis 28. The neck pillow 14 can extend from a first end 30, through a midpoint position 32, and to a second end 34. The neck pillow 14 can be formed from foam, can be inflatable, or can be formed from other material to define a pillow. The travel pillow assembly 10 can be utilized when a person has travelled away from his or her bed and desires to sleep comfortably.

With continuing reference to FIG. 1, in the exemplary embodiment, the first and second suspension member assemblies 16, 116 can be substantially similar, so only the first suspension member assembly 16 will be described in detail. However, it is noted that the first and second suspension member assemblies 16, 116 can be structurally different and provide similar functionality in one or more other embodiments of the present disclosure.

With continuing reference to FIG. 1, the first suspension member assembly 16 can be operatively connected to the first elongate member 18 along the belt length or axis 24. Operatively connected refers to connected to stay together under the weight to be applied to the travel pillow assembly 10. Some embodiments can apply stitching or adhesive, so that the first suspension member assembly 16 and the first elongate member 18 are fixedly connected. In other embodiments of the present disclosure, the first suspension member assembly 16 and the first elongate member 18 can be fixedly and releasibly connected. It is noted that in the exemplary embodiment, the first and second suspension member assemblies 16, 116 can be connected to the first elongate member 18 at different and spaced positions along the belt length. In other embodiments of the present disclosure, the first and second suspension member assemblies 16, 116 can be connected to the first elongate member 18 at the same position along the belt length.

[With continuing reference to FIG. 1, the first suspension member assembly 16 can extend a suspension member length. The suspension member length can be defined by the length between the first elongate member 18 and an opposite end of the first suspension member assembly 16. Since the first suspension member assembly 16 can be flexible, the suspension member length can be defined by extending the first suspension member assembly 16 to define a straight line to the extent reasonably possible. As set forth in greater detail below, some of the suspension member length can become "lost length" or slack when the travel pillow assembly 10 is in use. The suspension member length of the exemplary first suspension member assembly 16 is referenced at 36.

With continuing reference to FIG. 1, the first suspension member assembly 16 can be configured to releasibly form a pillow engagement loop 38. The pillow engagement loop 38 can be operable to selectively encircle the neck pillow 14 along the nonlinear axis 24 between the midpoint position 32 and one of the first and second ends 30, 34 of the neck pillow 14. In FIG. 2, the pillow engagement loop 38 encircles the neck pillow 14 between the midpoint position 32 and the second end 34.

With continuing reference to FIG. 1, the first suspension member assembly 16 can having a second buckle member 40 positioned along the suspension member length 36. The second buckle member 40 can be spaced from the pillow engagement loop 38 along the suspension member length 36. The second buckle member 40 can be configured to maintain the first suspension member assembly 16 in a plurality of different orientations whereby a distance between the second buckle member 40 and the pillow engagement loop 38 is adjustable along the suspension member length 36.

With continuing reference to FIG. 1, in the exemplary travel pillow assembly 10, the first suspension member assembly 16 can include a linking member 42, a loop-forming member 44, and a spacing member 46. The linking member 42 can extend between the first elongate member 18 and the second buckle member 40. The linking member 42 can be flexible. The linking member 42 can be elongate, in contrast to defining a continuous loop. The second buckle member 40 can be fixedly connected with the linking member 42. The second buckle member 40 can thus be spaced from the first elongate member 18.

With continuing reference to FIG. 1, the suspension member length 36 can be defined by a combination of lengths of the linking member 42, the loop-forming member 44, and the spacing member 46. The linking member 42 can define a non-adjustable portion of the suspension member length 36. The length of the exemplary linking member 42 is referenced at 48.

With continuing reference to FIG. 1, the loop-forming member 44 can be configured to define the pillow engagement loop 38. The loop-forming member 44 can be a strap extending between a first distal end 50 and a second distal end 52. Mating sections of hook and loop fasteners 54, 56 can be positioned proximate to the first and second distal ends 50, 52. The hook and loop fasteners 54, 56 can be brought together to close the pillow engagement loop 38 around the neck pillow 14. The length of the sections of the hook and loop fasteners 54, 56 can be varied to allow the size of the pillow engagement loop 38 to be adjustable.

With continuing reference to FIG. 1, since the size of the pillow engagement loop 38 can be adjustable, the overall suspension member length 36 can be adjustable. The loop-forming member 44 can thus define an adjustable portion of the suspension member length 36. The length of the exemplary loop-forming member 44 is referenced at 58.

With continuing reference to FIG. 1, the spacing member 46 can extend between and interconnect the second buckle member 40 and the loop-forming member 44. The spacing member 46 can extend between a first end 60 and a second end 62. The spacing member 46 can extend along a torturous path through the second buckle member 40. The engagement between the spacing member 46 and the second buckle member 40 results in the spacing member 46 being fixedly and releasibly engaged with the second buckle member 40. The distance between the first end 60 and the second buckle member 40 can be adjusted inversely relative to the distance between the second end 62 and the second buckle member 40. For example, drawing the spacing member 46 through the second buckle member 40 by the second end 62 during adjustment can move the first end 60 closer to the second buckle member 40.

As shown in FIG. 1 and described herein, the linking member 42, the loop-forming member 44, and the spacing member 46 can be structurally distinct from one another. The spacing member 46 can be elongate, in contrast to defining a continuous loop. The spacing member 46 can define an adjustable portion of the suspension member length 36. The length of the exemplary spacing member 46 is referenced at 64. Thus, in the exemplary embodiment, the lengths of the loop-forming member 44 and the spacing member 46 can be adjustable and the length of the linking member 42 can be fixed and the length of the loop-forming member 44 is less adjustable than the length of the spacing member 46.

With continuing reference to FIG. 1, the exemplary loop-forming member 44 and the spacing member 46 can be fixedly interconnected, such as by stitching at the first end 60. However, in one or more other embodiments of the present disclosure, the loop-forming member 44 can be releasibly attachable with respect to a remainder of the first suspension member assembly 16. The loop-forming member 44 and the spacing member 46 can be releasibly engaged with one another.

Figure 4:
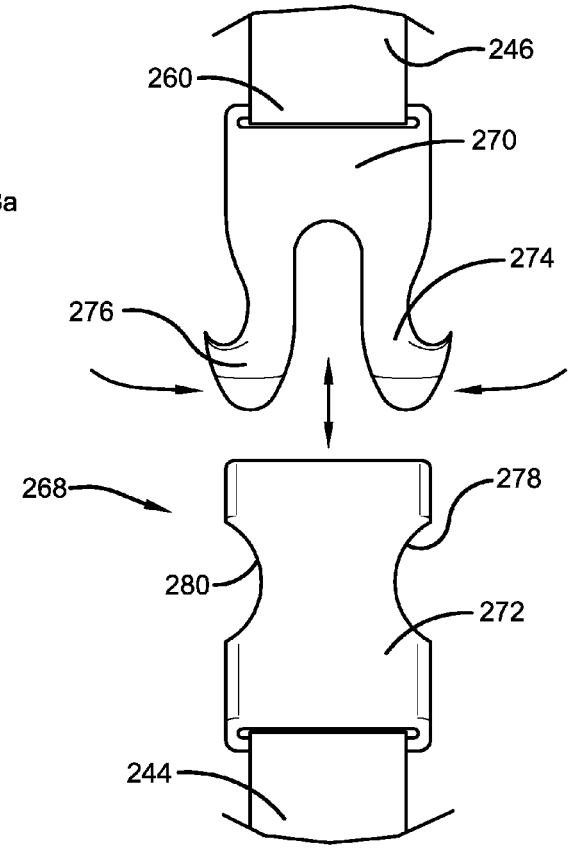
FIG. 4 is a generally planar view of a portion of another exemplary embodiment of the present disclosure.

For example, FIG. 1 shows that the second suspension member assembly 116 can include a spacing member 146 having a secondary loop 166 at a first end 160. A loop-forming member 144 having sections of the hook and loop fasteners 154, 156 can be passable through the secondary loop 166. FIG. 4 shows another alternative embodiment in which a snap-lock clasp or snapping latch 268 is utilized to interconnect a loop-forming member 244 and a spacing member 246. The latch 268 can include a male portion 270 disposed at the first end 260 of the spacing member 246. The latch 268 can also include a female portion 272 disposed the loop-forming member 44. The latch 268 can be configured to fixedly and releasibly the spacing member 246 and the loop-forming member 244. Pawls 274, 276 can be pressed together and inserted into the female portion 272. After passing into the female portion, the pawls 274, 276 can recover and expand into slots 278, 280 in the female portion 272, forming a snap-fit lock with the female portion 272.

In another embodiment of the present disclosure, shown FIGS. 5-9, a travel pillow assembly 10*a* can include a belt assembly with a first elongate member 18*a*, a neck pillow 14*a*, and first and second suspension member assemblies, such as first suspension member assembly 16*a*. The belt assembly of the embodiment shown in FIGS. 5-9 can be substantially the same as the belt assembly 12 of the embodiment shown in FIGS. 1-3. The neck pillow 14*a* of the embodiment shown in FIGS. 5-9 can be substantially the same as the neck pillow 14 of the embodiment shown in FIGS. 1-3.

Figure 5:
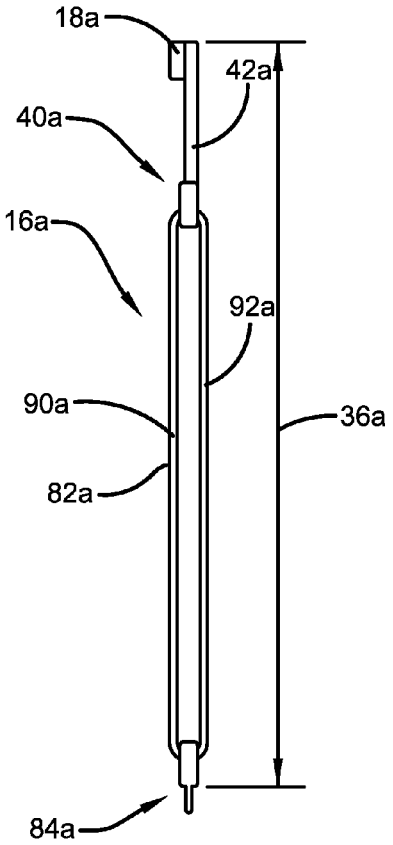
FIG. 5 is a side view of a portion of another exemplary embodiment of the present disclosure.
Figure 8:
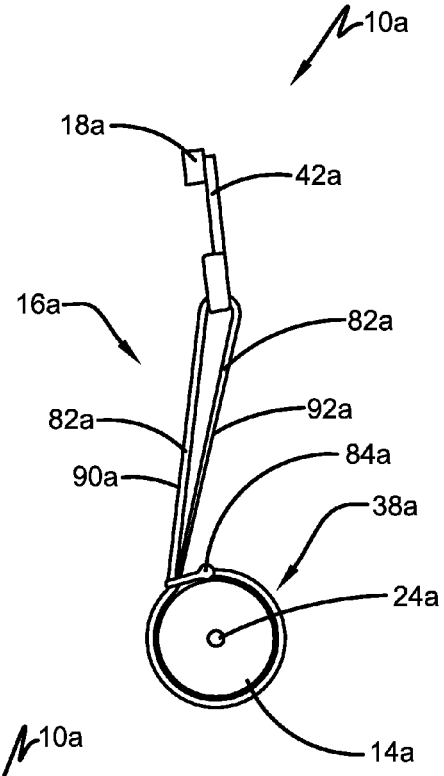
FIG. 8 is a first side view of the embodiment partially shown in FIG. 5 in an operating configuration.
Figure 9:
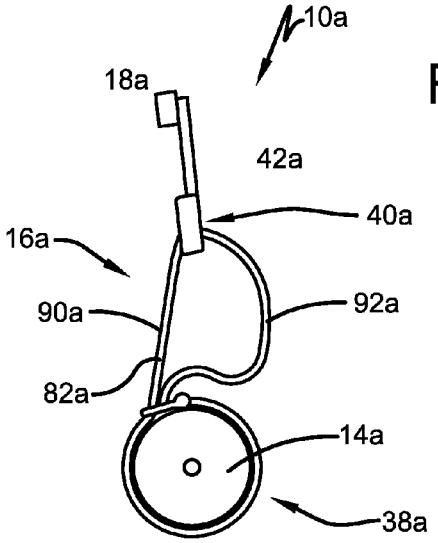
FIG. 9 is a second side view of the embodiment partially shown in FIG. 5 in an operating configuration.

With continuing reference to FIGS. 5, 8, and 9, the first suspension member assembly 16*a* can be operatively connected to the first elongate member 18*a* along the belt length and extend a suspension member length 36*a*. The first suspension member assembly 16*a* can be configured to releasibly form a pillow engagement loop 38*a* operable to selectively encircle the neck pillow 14*a* along the nonlinear axis 24*a* between the midpoint position and one of the first and second ends of the neck pillow 14*a*. The first suspension member assembly 16*a* can include a second buckle member 40*a* positioned along the suspension member length 36*a* and spaced from the pillow engagement loop 38*a* along the suspension member length 36*a*. The second buckle member 40*a* can be configured to maintain the suspension member assembly 16*a* in a plurality of different orientations whereby a distance between the second buckle member 40*a* and the pillow engagement loop 38*a* is adjustable along the suspension member length 36*a*.

Figure 6:
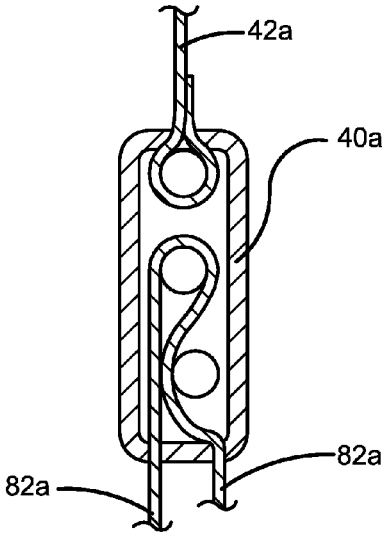
FIG. 6 is a cross-section through a buckle member of the embodiment partially shown in FIG. 5.

With continuing reference to FIGS. 5, 8, and 9, the first suspension member assembly 16*a* can include a linking member 42*a* and a composite member 82*a*. The composite member 82*a* can correspond to the combination of the spacing member 46 and the loop-forming member 44 of the embodiment shown in FIGS. 1-3. The linking member 42*a* can extend between the first elongate member 18*a* and the second buckle member 40*a*. The composite member 82*a* can be arranged as a flexible loop. The composite member 82*a* extends along a torturous path through the second buckle member 40*a*, as shown in FIG. 6, which is a cross-section through the second buckle member 40*a*.

Figure 7:
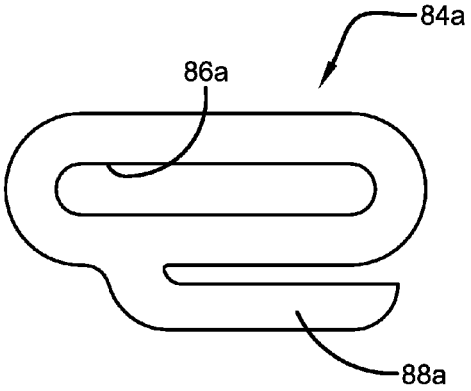
FIG. 7 is a planar view of clip of the embodiment partially shown in FIG. 5.

With continuing reference to FIGS. 5, 7, and 8, the first suspension member assembly 16*a* can also include a clip 84*a* having a slot 86*a* receiving the composite member 82*a* such that the clip 86*a* is slidable relative to the composite member 82*a*. The clip 84*a* can also have a hook portion 88*a*. The hook portion 88*a* can be configured to selectively receive the composite member 82*a* to form the pillow engagement loop 38*a* about the neck pillow 14*a*.

With continuing reference to FIGS. 5, 8, and 9, the composite member 82*a* can be configured to define the pillow engagement loop 38*a* by being wrapped around the neck pillow 14*a*. The clip 84*a* can fix a portion of a length of the composite member 82*a* about the neck pillow 14*a* when the hook portion 88*a* receives the composite member 88*a*. A remainder of the length of the composite member 82*a* remains adjustable after the hook portion 88*a* receives the composite member 88*a*.

FIG. 5 shows the first suspension member assembly 16*a* prior to use. FIG. 8 shows a bottom portion of the first suspension member assembly 16*a* wrapped around the neck pillow 14*a*. The hook portion 88*a* has received opposite sides 90*a*, 92*a* of the composite member 82*a*. Attempted expansion of the neck pillow 14*a* can causes the sides 90*a*, 92*a* to be pinched together. As a result, as shown in FIG. 9, the distance between the second buckle member 40*a* and the pillow engagement loop 38*a* can be adjusted. In FIG. 9, the side 92*a* has been pulled to draw the composite member 82*a* through the second buckle member 40*a*. The side 92*a* has slack while the side 90*a* remains taut.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or sub-combinations that are disclosed herein as other present disclosures in other patent documents is hereby unconditionally reserved.

What is claimed is:

1. A travel pillow assembly comprising:

a belt assembly including a first elongate member of flexible material extending a belt length between a first end and a second end and configured to elastically deform to surround a perimeter of another structure and a first buckle member receiving said first elongate member and configured to maintain said first elongate member in a plurality of different orientations whereby said belt assembly is operable to fixedly and releasibly surround a plurality of perimeters of different size;

a neck pillow extending a pillow length along a truncated, omega-shaped path about a nonlinear axis from a first end, through a midpoint position, and to a second end; and first and second suspension member assemblies, each operatively connected to said first elongate member along said belt length, each extending a respective suspension member length, each configured to releasibly form a respective pillow engagement loop operable to selectively encircle said neck pillow along said nonlinear axis between said midpoint position and one of said first and second ends of said neck pillow, each having a respective second buckle member positioned along said respective suspension member length and spaced from said pillow engagement loop along said respective suspension member length, said second buckle member configured to maintain said respective suspension member assembly in a plurality of different orientations whereby a distance between said second buckle member and said pillow engagement loop is adjustable along said respective suspension member length;

wherein at least one of said first and second suspension member assemblies is further defined as including:

a linking member extending between said first elongate member and said respective second buckle member;

a loop-forming member configured to define said respective pillow engagement loop; and a spacing member extending between and interconnecting said respective second buckle member and said loop-forming member, wherein said linking member, said loop-forming member, and said spacing member are structurally distinct from one another; and wherein said spacing member defines a secondary loop and said loop-forming member passes through said secondary loop.

2. The travel pillow assembly of claim 1 wherein said first and second suspension member assemblies are further defined as operatively connected to said first elongate member at different and spaced positions along said belt length.

3. The travel pillow assembly of claim 1 wherein a size of at least one said pillow engagement loops is adjustable.

4. The travel pillow assembly of claim 1 wherein at least one of said first and second suspension member assemblies is further defined as including:

a linking member being flexible and elongate and extending between said first elongate member and said second buckle member, said linking member defining a non-adjustable portion of said respective suspension member length.

5. The travel pillow assembly of claim 1 wherein at least one of said first and second suspension member assemblies is further defined as including:

a loop-forming member configured to define said respective pillow engagement loop, said loop-forming member further defined as releasibly attachable with respect to a remainder of said at least one of said first and second suspension member assemblies.

6. The travel pillow assembly of claim 5 further comprising:

a snap-lock clasp with a male portion disposed on one of said remainder of said at least one of said first and second suspension member assemblies and said loop-forming member and a female portion disposed on the other of said remainder of said at least one of said first and second suspension member assemblies and said loop-forming member, said snap-lock clasp configured to fixedly and releasibly interconnect said remainder of said at least one of said first and second suspension member assemblies and said loop-forming member.

7. The travel pillow assembly of claim 5 wherein said loop-forming member is further defined as passable through a secondary loop defined by said remainder of said at least one of said first and second suspension member assemblies.

8. The travel pillow assembly of claim 1 wherein at least one of said first and second suspension member assemblies is further defined as including:

a loop-forming member configured to define said respective pillow engagement loop, said loop-forming member further defined as including first and second distal ends and hook and loop fasteners positioned proximate to said first and second distal ends.

9. The travel pillow assembly of claim 1 wherein neither said linking member nor said spacing member defines a continuous loop.

10. The travel pillow assembly of claim 1 wherein said second buckle member is fixedly connected with said linking member and said spacing member extends along a torturous path through and is releasibly engaged with said second buckle member.

11. The travel pillow assembly of claim 1 wherein said loop-forming member and said spacing member are releasibly engaged with one another.

12. The travel pillow assembly of claim 1 wherein said respective suspension member length is defined by a combination of lengths of said linking member, said loop-forming member, and said spacing member, wherein the respective lengths of said loop-forming member and said spacing member are adjustable and the length of said linking member is fixed.

13. The travel pillow assembly of claim 12 wherein the length of said loop-forming member is less adjustable than the length of said spacing member.

14. The travel pillow assembly of claim 1 further comprising: a snapping latch interconnecting said loop-forming member and said spacing member.

15. The travel pillow assembly of claim 1 wherein second buckle member is further defined as spaced from said first elongate member.

16. The travel pillow assembly of claim 1 wherein at least one of said first and second suspension member assemblies is further defined as including:

a linking member extending between said first elongate member and said respective second buckle member; and a composite member arranged as a flexible loop, said composite member configured to define said respective pillow engagement loop by being wrapped around said neck pillow.

17. The travel pillow assembly of claim 16 further comprising:

a clip having a slot receiving said composite member such that said clip is slidable relative to said composite member and also having a hook portion configured to selectively receive said composite member to form said respective pillow engagement loop about said neck pillow.

18. The travel pillow assembly of claim 17 wherein said clip fixes a portion of a length of said composite member about said neck pillow when said hook portion receives said composite member and a remainder of the length of said composite member is adjustable.

* * * * *